United States Patent [19]

Saitoh

[11] Patent Number: 4,660,351

[45] Date of Patent: Apr. 28, 1987

[54] METHOD AND APPARATUS FOR AFFIXING A RIBBON TO A BAG

[75] Inventor: Takashi Saitoh, Tokyo, Japan

[73] Assignee: Technical Products Co., Ltd., Tokyo, Japan

[21] Appl. No.: 898,759

[22] Filed: Aug. 13, 1986

Related U.S. Application Data

[63] Continuation of Ser. No. 667,286, Nov. 1, 1984, abandoned.

[30] Foreign Application Priority Data

Dec. 13, 1983 [JP] Japan ..... 58-234806

[51] Int. Cl.[4] ..... B65B 51/04

[52] U.S. Cl. ..... 53/417; 53/138 A; 53/583

[58] Field of Search ..... 53/417, 419, 483, 370, 53/583, 134, 138 A; 226/113, 114; 493/961, 229, 232, 237, 343

[56] References Cited

U.S. PATENT DOCUMENTS

| | | | |
|---|---|---|---|
| 3,375,634 | 4/1968 | Järund | 53/417 |
| 3,483,801 | 12/1969 | Kupcikevicius | 53/134 |
| 4,062,383 | 12/1977 | Saito | 53/583 |
| 4,176,476 | 12/1979 | L'Hoir | 53/417 |
| 4,262,474 | 4/1981 | Reuter et al. | 53/389 |

*Primary Examiner*—John Sipos
*Assistant Examiner*—Donald R. Studebaker
*Attorney, Agent, or Firm*—Frishauf, Holtz, Goodman & Woodward

[57] ABSTRACT

In a method for affixing a ribbon to a bag containing rolls etc. the bag is continuously fed to a predetermined position. A tie material is continuously fed such that the tie material is close to the bag, is able to tie up the open top of the bag, and then is severed for a specific length. Also, the ribbon is continuously and longitudinally fed along the bag to the open top thereof and severed for a specific length. A tie piece severed from the tie material is wound around the open top to tie up the open top together with the ribbon and to affix the ribbon to the bag.

10 Claims, 19 Drawing Figures

METHOD AND APPARATUS FOR AFFIXING A RIBBON TO A BAG

This application is a continuation of application Ser. No. 667,286, filed Nov. 1, 1984 abandoned.

This invention relates to a method and an apparatus for affixing a ribbon such as a red, blue or green ribbon to a bag, which automatically, effectively, and neatly affixes a ribbon to a bag containing rolls, candies, cookies and the like.

It is easy to affix a ribbon to a bag containing candies or gifts, when the bag is rectangular box with stiff sides and a lid it is a difficult to affix a ribbon to a bag containing rolls, candies, cookies and the like when the bag is made of flexible materials such as cellophane and; moreover, if the ribbon affixed is not uniform. A conventional process to affix a ribbon to a bag is to feed a ribbon to an open top of the bag, to wind it around the open top, to tie up it in a bow and to cut it. In the conventional method, all processes mentioned above are performed manually. Therefore, neither effectiveness nor uniformity can be attained.

It is, therefore, an object of this invention to provide a method and an apparatus for automatically, effectively and uniformly affixing a ribbon to a bag.

To this end, according to one preferred embodiment of the invention, a tie material is tied around an open top of a bag. A ribbon is fed longitudinally along the bag to the open top and is affixed to the open top by tying the open top with the tie material.

To be specific, bags containing rolls, candies and the like are continuously fed to a predetermined position of a ribbon affixing apparatus. Then the tie material is continuously fed in the apparatus and is cut for a specific length at the same time a ribbon is fed from the bottom of the bag to the open top and is cut for a specific length.

Under the condition that the tie material is wound around the open top, both ends of the tie are twisted and close the open top. When the tie material is wound around the open top, it makes the ribbon tie to the open top such that the ribbon is affixed to the bag. In the above mentioned method, all processes can be automatically performed and thus effective and uniform ribbon affixing is obtained.

The above and further objects and novel features of the invention will more fully appear from the following detailed description when the same is read in connection with the accompanying drawings. It is to be expressly understood, however, that the drawings are for purpose of illustration only and are not intended as definitions of the limits of the invention.

Figure 13A:
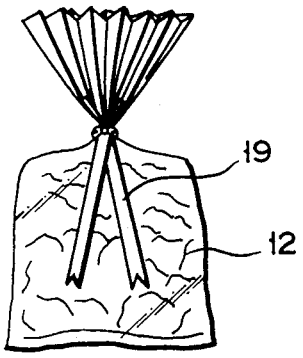
Figure 13B:
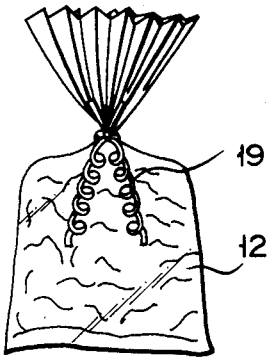
Figure 17A:
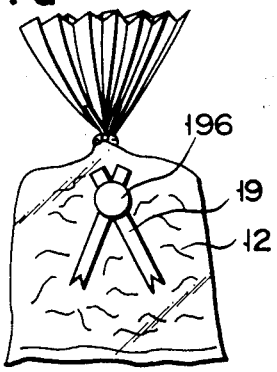
Figure 17B:
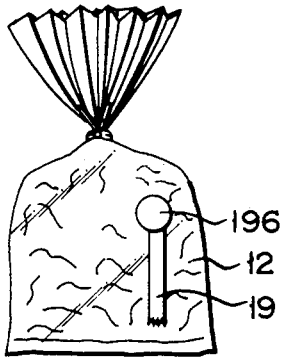
Figure 14:
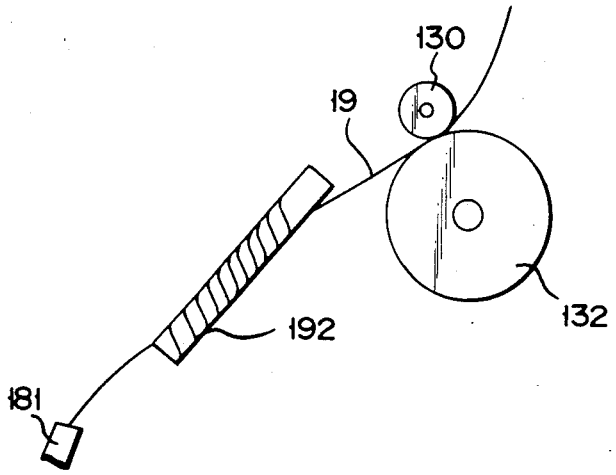
Figure 15:
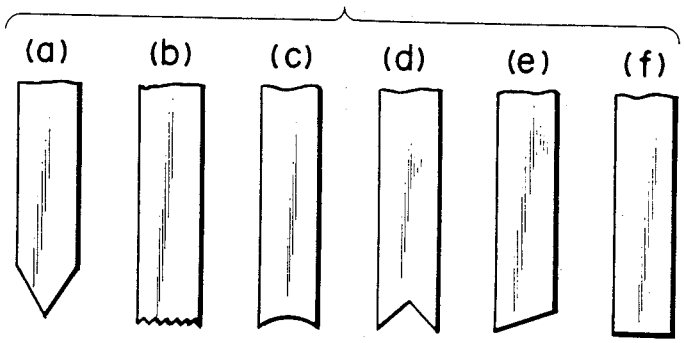
Figure 16:
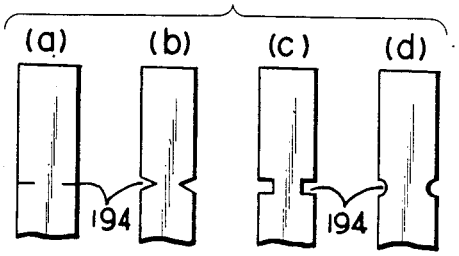

FIGS. 13(*a*) and 13(*b*) are front views of bags decorated with ribbons by the ribbon affixing apparatus;

FIG. 14 is a partial side view of one modified embodiment comprising a ribbon curling unit;

FIGS. 15(*a*) to 15(*f*) and 16 are partial front views of ribbons in various shapes; and FIGS. 17(*a*) and 17(*b*) are front views of bags affixed with ribbons by adhesive labels.

Figures 1, 2:
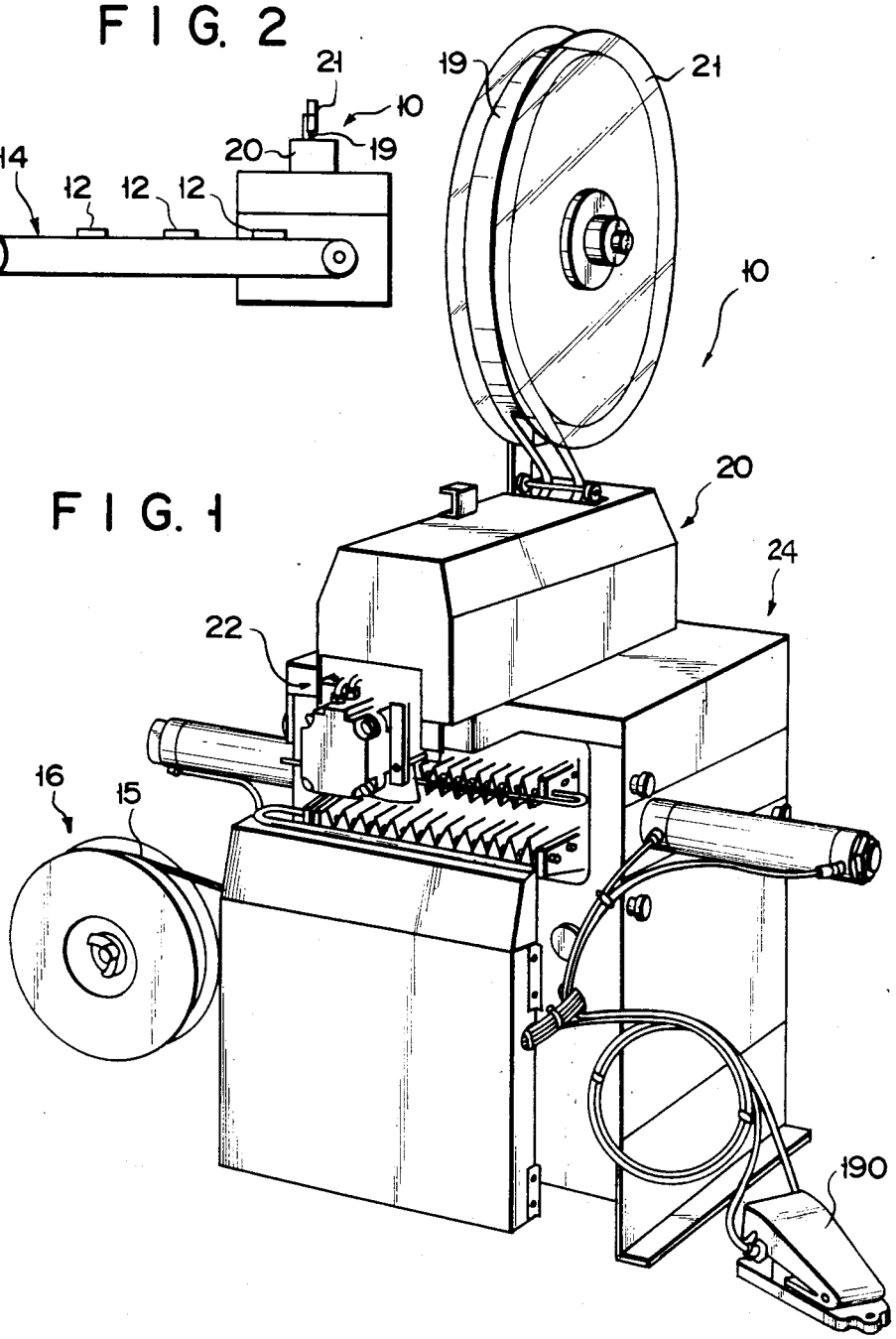
FIGS. 1 and 2 are perspective and schematic front views of a ribbon affixing apparatus according to this invention.

A summary of the method for affixing a ribbon to a bag by the ribbon affixing apparatus 10 according to the present invention are as follows in connection with FIGS. 1 and 2.

Bags 12 are continuously fed to a predetermined position by a bag feeding unit 14. A tie material 15 is fed to the open end of each bag 12 by means of a tie feeder 16. On the other hand, a ribbon 19 to be affixed to the bag 12 is pulled out from a reel 21 by means of a ribbon feeding unit for a specific length and longitudinally fed along the bag 12 to the open top thereof. A tie piece 15*a* is severed from the tie material 15 by means of the tie cutter 23 (see FIG. 5) and the ribbon 19 is also severed for a specific length by means of a cutter 186 housed in a ribbon cutter unit 22 (see FIG. 8). Then the tie piece 15*a* is wound around the open top of the bag 12 and both ends of the tie piece are twisted by a twisting mechanism 25 so as to tie up the open top. Simultaneously, the tie piece 15*a* makes the ribbon 19 affix to the open top.

The bag feeding means 14 may be a belt conveyor and operates to feed the next bag 12 to the predetermined position in the ribbon affixing apparatus 10, whenever the last bag 12 has been decorated with the ribbon 19. This operation can be performed by a well-known means such as a mechanism in which a driving motor is controlled by limit switches.

Figure 3:
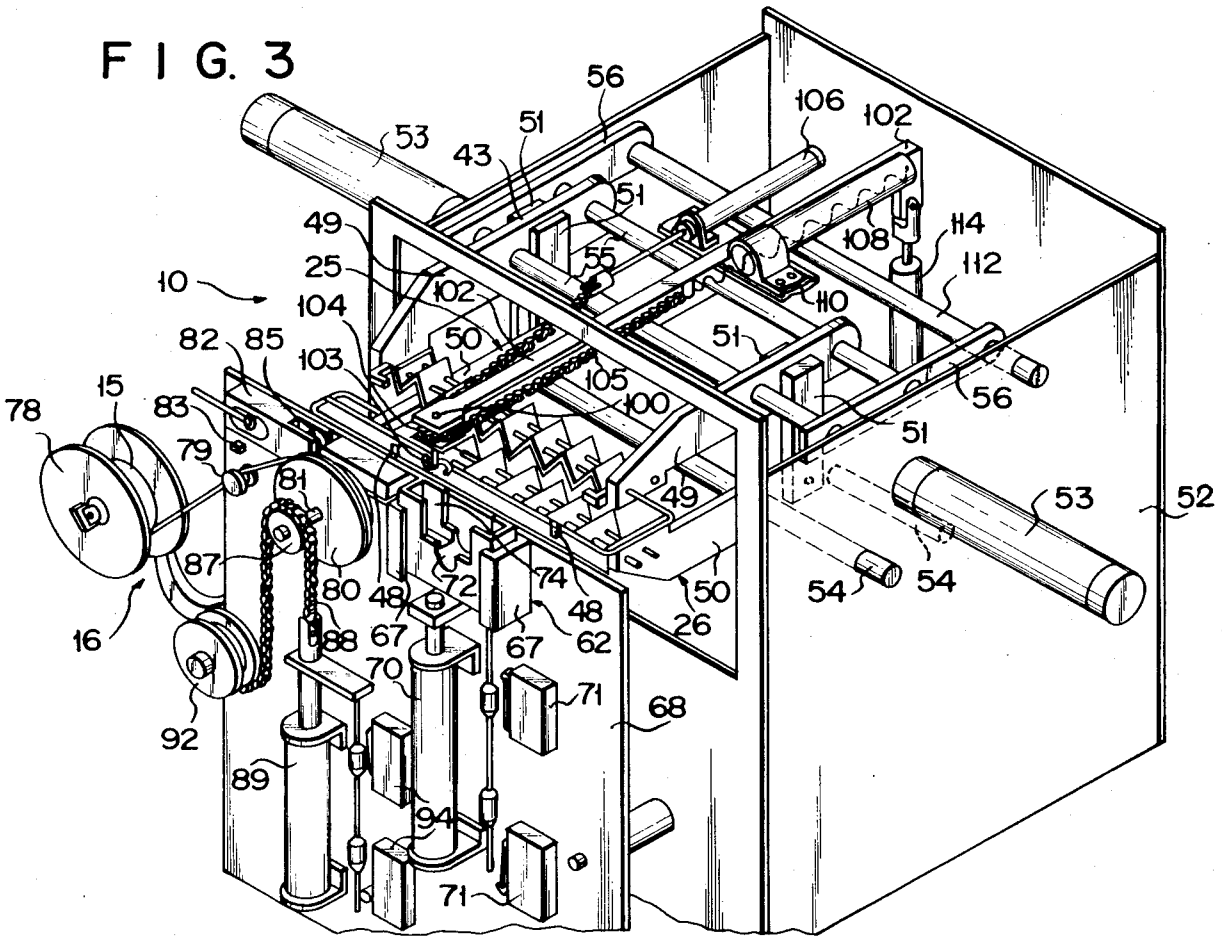
FIGS. 3 and 6 are perspective front views of the ribbon affixing apparatus shown in FIG. 1 with a ribbon feeder broken away for clarity.
Figure 4:
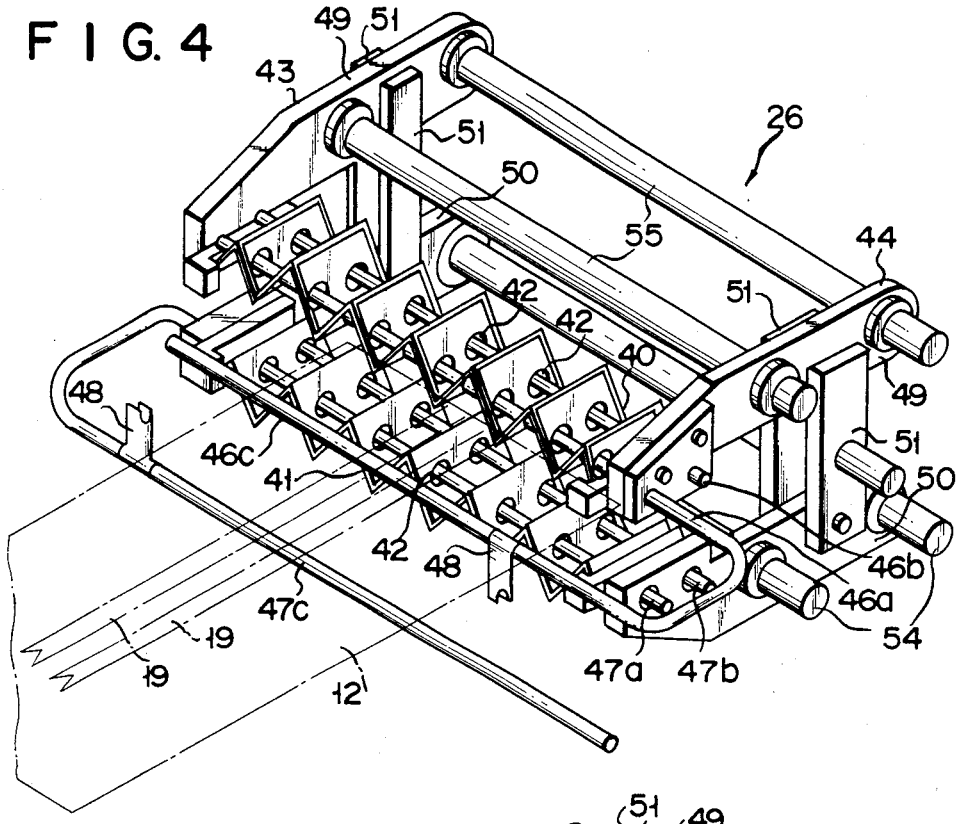
FIGS. 4 and 11 are perspective views of a pleating mechanism in non-operating condition and in operating condition, respectively.

The bag 12 fed by the bag feeding means 14 is gathered at its open top by a pleating mechanism 26. As shown in FIGS. 3 and 4, the pleating mechanism 26 includes a pair of pleating plates 40 and 41, which run parallel to each other horizontally and which are separated from each other vertically. Each pleating plate is bent in zigzag fashion to have several turns or accordian presses. The accordian presses each have two through holes 47 formed on the same level. The pleating plates 40 and 41 are made of a plastics sheet, e.g. a polypropylene sheet so that each accordian press resiliently bends at its apex. Further, each accordian press is lined with a thin metal sheet so as to withstand hundreds of thousands of pleating operations without any fatigue.

The ends of each pleating plate are fixed to brackets 43 and 44, respectively. A pair of parallel bars 46*a* and 46*b* pass through the holes 47 of the accordian presses and are extended between the brackets 43 and 44. Similarly, another pair of parallel bars 47*a* and 47*b* pass through the holes 42 of the lower pleating teeth and are extended between the brackets 43 and 44. The bars 46*a* and 46*b* run horizontally and parallel to the bars 47*a* and 47*b*, spaced from the bars 47*a* and 47*b* for a distance. The pleating plates 40 and 41 therefore extend parallel to each other and are spaced from each other vertically for a specific distance.

The right ends of the bars 46*a* and 46*b* are fixed to the bracket 44, while the left ends are slidably fitted in the bracket 43. To the right end of the bar 46*a*, there is connected a U-shaped bar 46*c* which lies at the same level as the bar 46*a*. By contrast, the left ends of the bars 47*a* and 47*b* are fixed to the bracket 43, while the right ends are slidably fitted in the bracket 44. To the left end of the bar 47*a*, there is connected a U-shaped bar 47*c* which lies at the same level as the bar 47*a*. The U-shaped bars 46*c* and 47*c* may be integrally formed with the bars 46*a* and 47*a*, respectively. On each U-shaped bar there is slidably mounted a guide claw 48 which extends in vertical direction and which is constituted by a metal round bar and a plastics sheet covering the bar. The guide claws 48 cooperate to clamp the gathered neck of a bag so firmly that the shoulder of the bag is made perpendicularly to the neck. The plastics cover serves to soften the impact between the gathered neck and each guide claws 48 thereby to avoid tearing of the bag 12.

The brackets 43 and 44 are each constituted by a pair of parallel arms 49 and 50 and a pair of connection plates 51. The lower ends of the connection plates 51 are fixed to the lower arm 50, as if to sandwich the same. The upper ends of the connection plates 51 define a space in which the upper arm 49 is slidably received. To the outer connection plate 51 of each bracket there is connected a driving means such as an air cylinder unit 53 or C2 (see FIG. 10). The lower arms 50 have two through holes each, through which a pair of parallel bars 54 extend slidably and horizontally and are secured to the frame 52. Similarly, the upper arms 49 have two through holes each, through which a pair of parallel bars 55 extend slidably and horizontally. But the parallel bars 55 are extended between two links 56. The rear ends of these links 56 are connected to a pivot 112.

As shown in FIG. 4, the open top of the bag 12 is inserted through between the guide claws 48 and between the U-shaped bars 46*c* and 47*c* until it is placed between the upper and lower pleating plates 40 and 41. The guide claws 48 may be slidably moved on the respective U-shaped bars, so that the distance between them is adjusted to the width of the bag.

Figure 5:
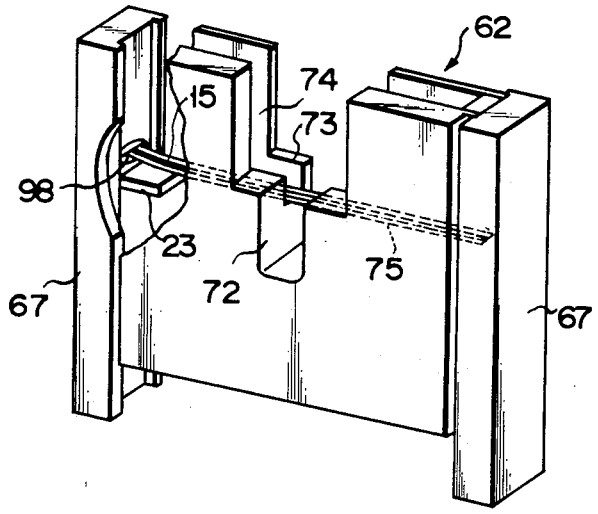
FIGS. 5 and 12 are perspective views of a forming plate which is in the lower and upper conditions, respectively.
Figure 6:
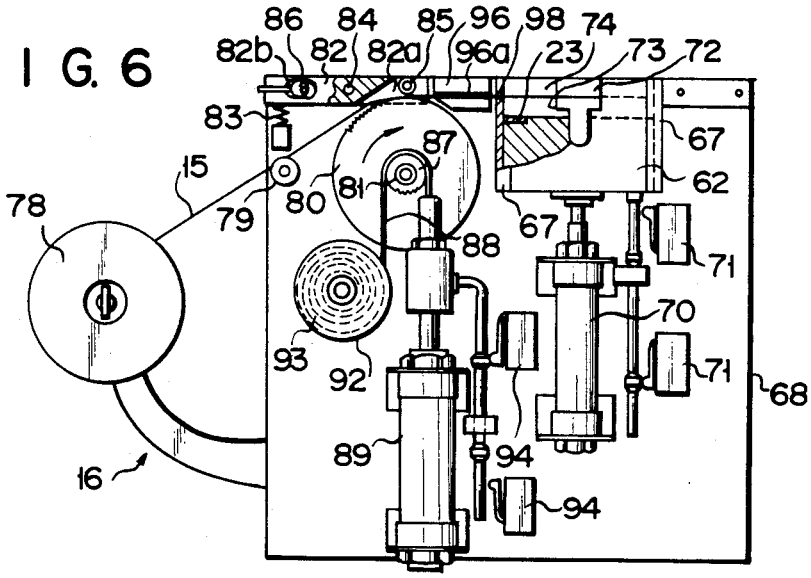

As shown in FIG. 3, a forming plate 62 is provided in front of the pleating mechanism 26. The forming plate 62 is slidably supported between a pair of guide plates 67 secured to a front support plate 68 as shown in FIG. 6 in addition to FIG. 3. Below the plate 62 an air cylinder unit 70 or C3 (see FIG. 10) is secured to the front support plate 68 and moves the plate 62 linearly up and down. The reciprocation of the piston of the air cylinder unit 70 is controlled by a pair of limit switches 71 or LS3 and LS5 (see FIG. 10) attached on the front support plate 68. As shown in FIG. 5, the forming plate 62 has a stepped groove 72 which extends in moving direction of the plate and an elongated recess 74 which rns across the stepped groove 72. On the bottom 75 of the recess 74 is placed the leading tip of resilient tie material 15 fed from the tie feeder 16. The elongated recess 74 is as broad as the tie material 15 so that the tie material 15 would not move sideways once placed in the recess 74.

It is preferred that the bottom 75 of the recess 74 be positioned at the level below the shoulders 73 of the stepped groove 72. The bottom 75 being so positioned, the shoulders 73 guide the tie material 15 to prevent the same from moving sideways in the stepped groove 72, more effective than otherwise.

On the left side of the forming plate 62 the tie cutter 23 is detachably fitted on the same level as the bottom 75 of the recess 74. When the plate 62 is moved upward, the tie cutter 23 severs a tie piece 15*a* from the tie material 15 fed from the tie feeder 16.

As shown in FIGS. 3 and 6, the tie feeder 16 comprises a reel 78 on which the tie material 15 is wound many times, a guide roller 79 which guides the tie material from the reel, a feed roller 80 which receives the tie material from the guide roller 79. The tie feeder 16 further comprises a tension arm 82 which extends substantially horizontal and which is disposed near the feed roller 80. Urged by a compression coil spring 83, the arm 82 is rocked about a pivot 84 which is secured to the front support plate 68. A groove 82*a* is formed in one end of the arm 82. In the groove 82*a* there is disposed a small roller 85. Since the arm 82 urged clockwise by the bias force of the spring 83, the small roller 85 is pressed onto the feed roller 80. Between the small roller 85 and the feed roller 80 the tie material 15 is to be sandwiched.

The arm 82 has an elongated through hole 82*b* to the left of the pivot 84. Through the hole 82*b* an eccentric toggle bar 86 is rotatably attached to the front surface plate 68. When the toggle bar 86 is rotated counterclockwise, the arm 82 is rocked counterclockwise against the bias force of the spring 83. Then the small roller 85 leaves the feed roller 80 a little, and a gap is formed between the rollers 80 and 85. Into this gap the leading tip of the tie 15 is easily inserted.

On the shaft 81 of the feed roller 80 there is fixed a toothed disc 87 such as a sprocket wheel, around which a chain 38 is wound. One end of the chain 88 is connected to a drive means such as an air cylinder unit 89 or C5 (see FIG. 10), and the other end to a spiral spring 93 housed in a roller 92. As the air cylinder unit 85 pulls the chain 88, the feed roller 80 turns clockwise so as to feed the tie 15 to the forming plate 62. The air cylinder unit 89 is controlled by a pair of limit switches 94 on the front support plate 68. If the air cylinder unit 89 or LS6 (see FIG. 10) is so controlled as to pull the chain 86 for a specific distance, the feed roller 80 rotates for a specific angle thereby to feed a certain length of the tie 15 to the plate 62. When the air cylinder unit 89 is put into non-operative state, the roller 92 takes up the chain 88, rotated by the bias force of the spiral spring 93. Thus, the chain 88 comes to assume its initial position, and so does the feed roller 80. The sprocket wheel 87 functions as an idle pulley whenever it rotates counterclockwise. For this reason the feed roller 80 would not rotate while the chain 88 is taken up by the roller 92. Thus, the tie material 15, once fed to the plate 62, will never retreat to the feed roller 80. The leading tip of the tie material 15 is fed into the elongated recess 74 of the forming plate 62 via a guide passage 96*a* of a guide block 96 secured to the support plate 68 and via a slot 98 of the plate 62.

The tie material 15 may be a plastic strip with a wire which is embedded in the strip and extending along the center line of the strip. A length of the tie piece 15*a* inserted in the elongated recess 74 is cut by the tie cutter 23 from the tie material 15 when the forming plate 62 is moved up. The tie piece 15*a* thus severed from the tie material 15 is left on the bottom 75 of the recess 74.

The twisting mechanism 25 comprises, as shown in FIG. 3, a twist shaft 100 disposed above the narrow section of the stepped groove 72 of the forming plate 62 and rotatably attached to the front end of a support arm 102, a pair of twist hooks 103 (see FIG. 12) secured to the lower end of the twist shaft 100, and a toothed disc such as a sprocket wheel 104 secured to the upper end of the twist shaft 100. Around the sprocket wheel 104 a chain 105 is wound to rotate the twist shaft 100. The ends of the chain 105 are connected to a drive means such as an air cylinder unit 106 or C4 (see FIG. 10) and a tension coil spring 108, respectively. Both the air cylinder unit 106 and the tension coil spring 108 are attached to a support plate 110 which is secured to the frame 52. The frame 52 supports the pivot 112 rotatably. The pivot 112 extends through the support arm 102. The rear end of the arm 102 is connected to a drive means such as an air cylinder unit 114 or C1 (see FIG. 10) which is fixed to the frame 52 by means of an angle bar (not shown). The air cylinder unit 114 alternately pulls and pushes the rear end of the arm 102 so as to rock the arm 102 about the pivot 112.

Figure 7:
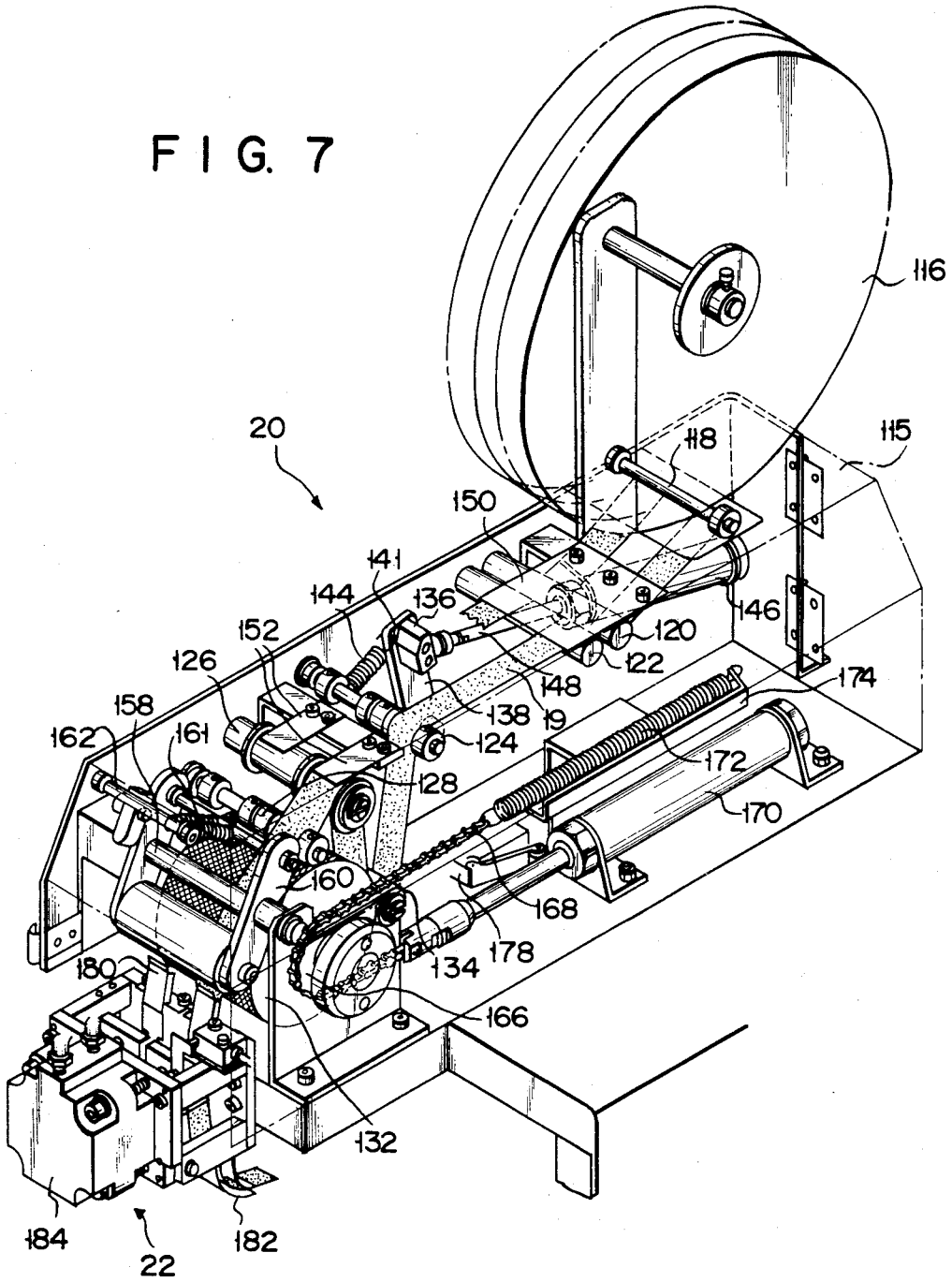
FIGS. 7 and 8 are perspective and partially cutaway right side views of a ribbon feeding means.
Figure 8:
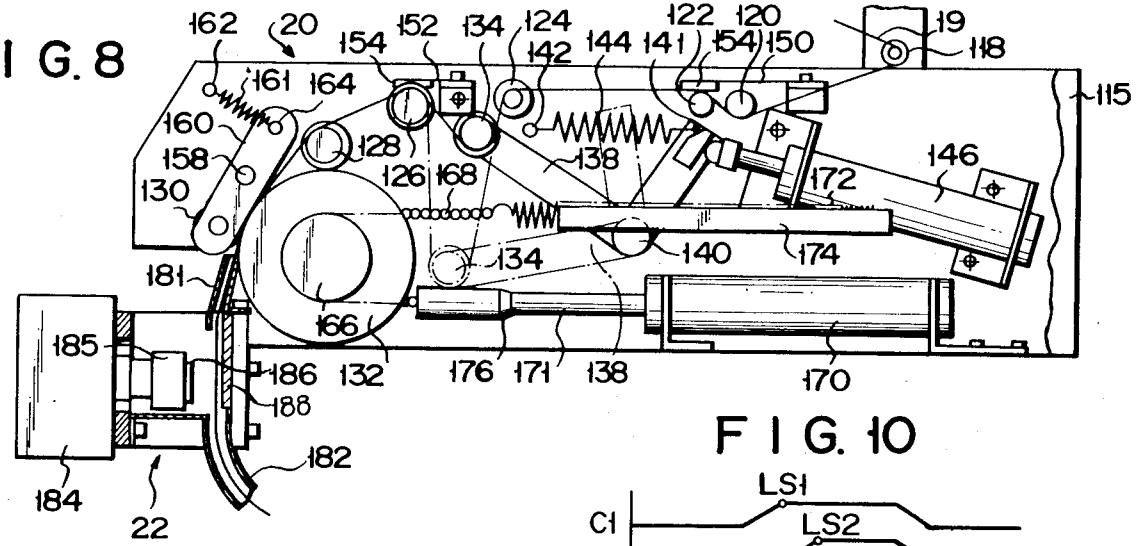

As seen from FIGS. 7 and 8, reel 21 is located on the frame 52 in which the ribbon feeding means 20 is housed. Also, a guide roller 118 is rotatably supported by the strut of the reel 21, and guide rollers 120, 122, 124, 126, 128, a pinch roller 130, and a feed roller 132 are rotatably supported in the frame 115, respectively. A tension arm 138 whose one end supports a tension roller 134 and whose another end a stopper 136, is located in the frame 115 by means of a shaft 140.

The ribbon 19 guided by the guide rollers 118, 120, 122, 124, 126 and 128 is wound around the tension roller 134 between the guide roller 124 and the guide roller 126. A tension coil spring 144 which is stretched between a hole 141 formed on one end of the arm 138 and a pin embedded on the frame 115 biases counterclockwise the arm 138 around the shaft 140. A driving means such as an air cylinder unit 146 or C6-2 (see FIG. 10) is located in the frame 115 and is constructed such that the front end of the piston 148 thereof presses the stopper 136. By this construction, when the piston 148 moves forward for a specific distance, the arm 138 rotates counterclockwise around the shaft 140 by the pressure force of the piston 148 and the bias force of the spring 144, and the tension roller 134 moves from the position shown one as shown by a real line to in a one-dotted chain line. By this movement of the tension roller 134, the ribbon 19 is pulled out from the reel 21 for a specific length and is tightened under a back tension. In this way, the ribbon 19 is pulled out for a specific length without a sag under the back tension, and as explained later, the desired length of the ribbon 19 moves forward under a constant torque and the back tension. The ribbon 19 is pressed on the guide rollers 122 and 126 by pressure plates 150 and 152, on lower surfaces of which felts 154 are adhered to prevent the ribbon 19 from being damaged.

The pinch roller 130 is supported on one end of a support plate 160 which is rockably disposed in the frame 115 by a shaft 158. A tension coil spring 161 stretched between a pin 162 embedded in the frame 115 and a hole 164 formed on the other end of the support plate 160, and biases counterclockwise the support plate 160 around the shaft 158. Therefore, the pinch roller 130 is pressed to the feed roller 132 and sandwiches the ribbon 19 fed from the guide roller 128 therebetween.

On the shaft of the feed roller 132, a drive roller such as a sprocket wheel 166 is disposed in such a well-known manner that it makes the feed roller 132 rotate counterclockwise together, only when it rotates in the ribbon feeding direction, while it does not make the feed roller 132 rotate together when rotating in the clockwise direction. A zonal member such as a chain 168 is wound on the sprocket wheel 166, one end of the chain 168 is connected to one end of a driving means such as an air cylinder unit 170 or C6-1 (see FIG. 10) and the other end to the left end of the tension coil spring 172. The zonal member may be a toothed belt, and the drive roller a spur gear. The spring 172 is covered with a cover member 174. Specifically, the right end of the spring 172 is engaged with the cover member 174. When pressurized air is supplied into the air cylinder unit 170 and the piston 171 thereof is retreated against the bias force of the spring 172, the chain 168 makes the sprocket wheel 166 rotate counterclockwise for a specific angle. Simultaneously, pressurized air is supplied into the cylinder unit 146 or C6-2 to retreat the piston thereof. The feed roller 132 rotates counterclockwise together with the sprocket wheel 166.

Therefore, the ribbon 19 which has been pulled out from the reel 21 for a specific length and has been tightened under the back tension moves forward for the desired length against the bias force of the spring 144. When the piston 171 is retracted for a specific length, an inclined face 176 formed on the piston 171 acts as an operation arm of a limit switch 178 or LS7 (see FIG. 10) secured on the frame 115 which operates to stop the supply of pressurized air. When the supply of pressurized air is stopped, the chain 168 is pulled by the bias force of the spring 172 and makes the sprocket wheel 166 rotate clockwise, while the feed roller 132 never rotates as mentioned above.

The ribbon 19 is moved forward from the feed roller 132 through a front shooter 181 to a rear shooter 182 of a cutter unit 180, and longitudinally fed from the bottom to the open top of the bag 12 until the leading tip of the ribbon reaches above the open top of the bag. The ribbon 19 may be also fed in the opposite direction, namely, from the open end to the bottom of the bag 12.

Figure 9:
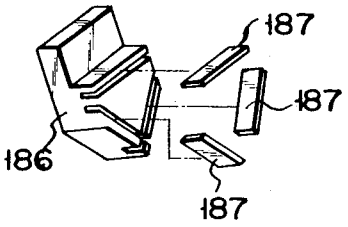
FIG. 9 is a perspective view of a ribbon cutter.

The cutter unit 180 includes a driving means such as an air cylinder 184 or C7 (see FIG. 10) and a cutter 186 which is fixed to one end of the piston 185 of the air cylinder unit 184. As shown in FIG. 9, three blades 187 are provided on the cutter 186. Facing the cutter 186, a mat member 188 is provided. When the piston 185 moves forward, the cutter 186 presses the ribbon 19 onto the mat member 188 and severs the ribbon 19. The mat member 188 may be made of plastics such as Bakelite, Teflon or soft materials such as rubber, so as to avoid damaging of the blades 187. If a laser cutter is used, it is easy to cut ribbons in many shapes. As explained later, the ribbon 19 is pleated together with the open top of the bag 12 by means of the pleating plates 40 and 41 and is affixed to the open top by means of the tie piece 15*a*. Once leading tip of the ribbon 19 has been fed above the open end of the bag 12, it can be severed at anytime. As shown in FIG. 7, two pieces of ribbon can be simultaneously fed.

A detailed explanation of a method for affixing a bag to a bag according to the ribbon affixing apparatus 10 as explained above is as follows.

Figure 10:
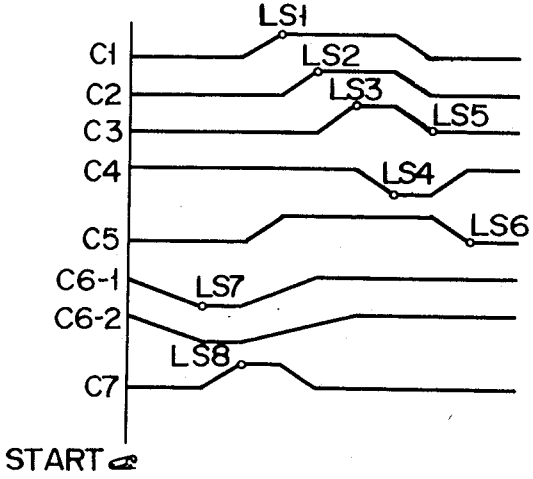
FIG. 10 is a timing chart showing operations of air cylinder units.

The bag 12 is inserted between the guide claws 48 and between U-shaped bars 46*c* and 47*c* until it gets to the predetermined position between pleating plates 40 and 41 (see FIG. 4). When the bag 12 is fed to the predetermined position in the ribbon affixing apparatus 10, a foot switch 190 is stepped and a circuit of pressurized air is closed. As shown in FIG. 10, the operation of the foot switch 190 allows pressurized air to be supplied into the air cylinder unit 170 or C6-1 and the piston 171 retreats for a specific distance. Simultaneously, pressurized air is supplied into the air cylinder unit 146 or C6-2 to retreat the piston thereof. The sprocket wheel 166 rotates counterclockwise for a specific angle together with the feed roller 132. Therefore, the ribbon 19 sandwiched between the feed roller 132 and the pinch roller 130 forwards for a specific distance until its leading tip is fed above the open top of the bag 12 between the pleating plates 40 and 41 in the longitudinal direction of the bag (see FIG. 5).

The forward movement of the ribbon 19 for a specific distance makes the tension roller 138 return against the bias force of the spring 144 to the position shown in real line in FIG. 8. When the piston 171 is drawn to the predetermined position, the switch 178 or LS7 is turned on and that pressurized air is supplied into the air cylinder unit 184 or C7. Then, the switch LS8 turn on to forward the air piston cylinder unit 184 or C7 and the cutter 186 connected to its piston, and the cutter severs the ribbon 19. Next, pressurized air is supplied into the air cylinder unit 114 or C1 to move forward its piston and thereby the end of the arm 102 connected to the piston rotates counterclockwise around the pivot 112, then parallel bars 55 descend. Also, parallel arms 49 and 50 counterclockwise rotate around the pivot 112 and an upper pleating plate 40 descends so that the open top of the bag 12 and the ribbon 19 may be sandwiched between the upper pleating plate 40 and the lower pleating plate 41.

Figure 11:
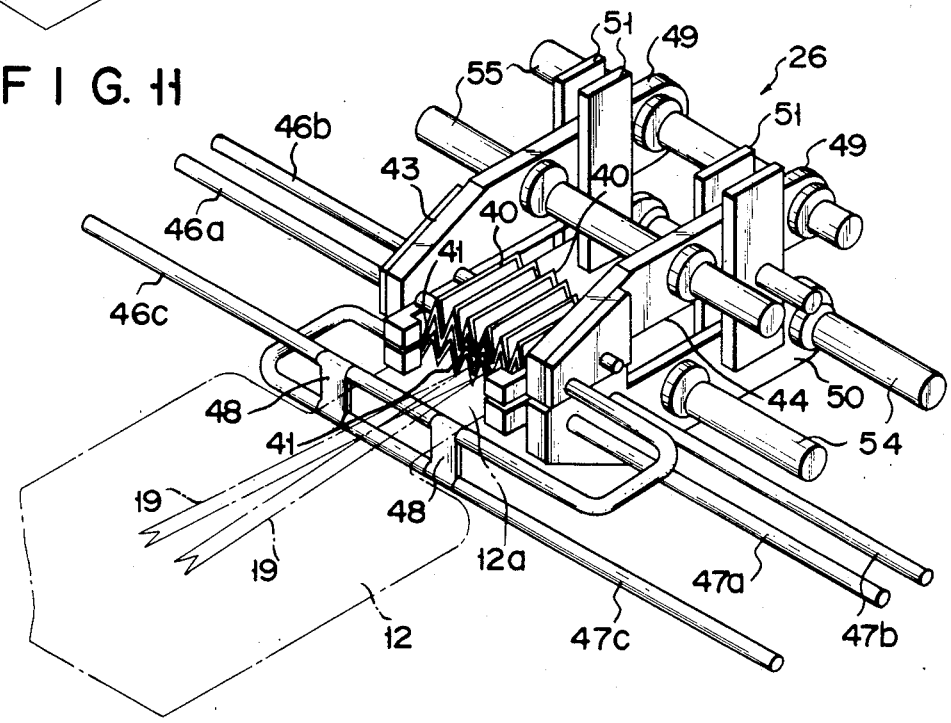

Then, referring to FIG. 10, by an operation of a limit switch LS1, pressurized air is supplied into another pair of air cylinder units 53 or C2 and the piston of the cylinder forwards, brackets 43 and 44 connected to the pistons approach each other, and the open top of the bag 12 is gradually gathered by the pleating plates 40 and 41 so as to form a gathered neck 12*a* as shown in FIG. 11. At this stage, the ribbon 19 is also gathered together with the open top of the bag 12. As the brackets 43 and 44 approach each other, the parallel bars 46*a* and 46*b* move to the left direction and the parallel bars 47*a* and 47*b* to the right, respectively. Therefore, the upper U-shaped bar 46*c* connected to the bar 46*a* moves to the left and the upper U-shaped bar 47*c* connected to the bar 47*a* moves to the right. As a result, the guide claws 48 fixed on the U-shaped bars approach each other.

The open top of the bag 12 is completely gathered and the gathered neck 12*a* and the ribbon 19 are firmly held between the guide claws 48. As a result, the shoulder of the bag is perpendicular to the neck, and the bag is so shaped as to give an impression that it is filled up with contents.

Figure 12:
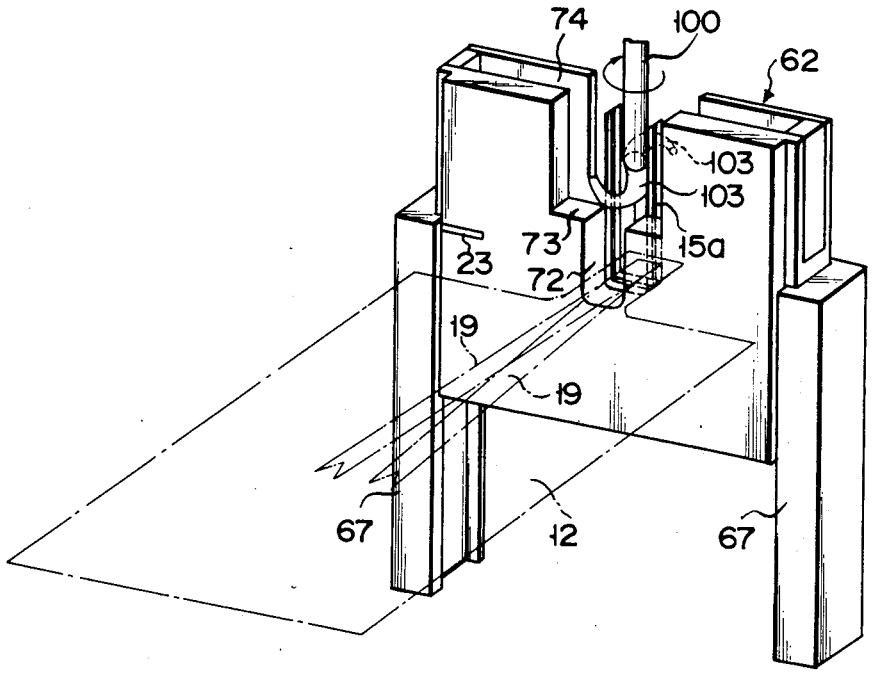

In the next operational stage as shown in FIG. 10, by the operation of a limit switch LS2, the air cylinder unit 70 or C3 is supplied with pressurized air and its piston rises together with the forming plate 62. As best illustrated in FIGS. 5 and 12, when the plate 62 has risen, the tie piece 15*a* is severed from the tie material 15 by means of the cutter 23 and is left on the bottom 75 of the elongated recess 74 of the forming plate 62. While, as explained above, the gathered neck 12*a* of the bag 12 is placed above the stepped groove 72 of the plate 62 together with the ribbon 19. As the plate 62 further rises, the gathered neck 12*a* of the bag 12 and the ribbon 19 are caught in the narrow section of the stepped groove 72 and the tie piece 15*a* is bent in U-shaped around the neck 12*a* of the bag 12, as shown in FIG. 12. At this stage, the twist hooks 103 of the twisting mechanism 25 can engage with both ends of the U-shaped tie piece 15*a*.

Then, as shown in FIG. 10, the limit switch LS3 operates and the air cylinder unit 106 or C4 is supplied with pressurized air with the result that its piston retreats. As the piston retreats, the chain 105 is drawn against the bias force of the tension coil spring 108. The sprocket wheel 104 is driven to make the twist hooks 103 rotate and thereby to twist both ends of the tie piece 15*a*. As a result, the gathered neck 12*a* of the bag 12 is firmly tied by the tie piece 15*a* together with the ribbon 19.

When the above mentioned tying operation has been finished, in FIG. 3 the air cylinder units 53 operate so as to make the brackets 43 and 44 return to their initial positions. Therefore, the pleating mechanism prepares for the next pleating operation. The air cylinder unit 114 serves to lower the rear end of the support arm 102. The twist hooks 103 and upper pleating plate 40 return to their initial positions. A limit switch LS4 turns on and the air cylinder unit 70 operates to make the forming plate 62 return to its initial position. When the limit switch 71 or C5 turns on, the air cylinder 89 (see FIG. 6) serves to draw the chain 88 and, the shaft 81 and the feed roller 80 rotate clockwise for a specific angle. Therefore, a specific length of the tie material 15 is fed in the elongated recess 74 of the forming plate 62.

The summary of the method for affixing a ribbon to a bag according to the preferred embodiment above-mentioned is as follows.

(1) The bag 12 containing rolls, candies, cookies and the like is continuously fed to the predetermined position between the pleating plates 40 and 41 of the pleating mechanism 26 by means of the bag feeding mechanism 14. The ribbon 19 is continuously fed by the ribbon feeding means 20 such that its leading tip is placed between the pleating plates, and is severed by the cutter 186. On the other hand, the tie material 15 is fed to the bottom 75 of the elongated recess 74 of the tie wrapping plate 62.

(2) The upper pleating plate 40 descends so as to sandwich the open top of the bag 12 and the ribbon 19 between the same and the lower pleating plate 41, the parallel arms 49 and 50 approach each other to pleat the open top and to form the gathered neck 12*a* of the bag 12. The guide claws 48 form the shoulder of the bag.

(3) The forming plate 62 rises and severs the tie material 15 for a specific length. The tie piece 15*a* severed from the tie material 15 is bent in U-shape around the gathered neck 12*a* of the bag 12.

(4) The twist hooks 103 rotate and twist the tie piece 15*a* so that the gathered neck 12*a* of the bag 12 together with the ribbon 19 is firmly tied by the tie piece 15*a*.

(5) The upper pleating plate 40 rises, parallel arms 49 and 50 are separated from each other and the bag is brought out.

According to the above-mentioned method, automatical, effective and uniform affixing the ribbon to the bag is easily obtained.

FIGS. 13(*a*) and 13(*b*) show various kinds of decorating forms of the ribbons 19 affixing to the bags. FIG. 13(*a*) shows two ribbons affixed to the bag 12 in inverted V-shape and that they have more decorative effects than one ribbon affixed. To affix two ribbons in inverted V-shape to the bag 12 as shown in FIG. 13(*a*), it is necessary, for example, to feed two ribbons 19 wound on two different reels, to make each ribbon 19 in the conditions that one is over the other by means of the front shooter 181, and to forward them under the same condition to the open top of the bag from the rear shooter 182. The cutter 186 severs the ribbons 19 for a specific length and the tie piece 15*a* securely tie up the gathered neck of the bag together with the ribbons 19.

After that, when the bag 12 is brought out, a twist which is formed on the leading tip when the ribbons are pleated, returns and forms an inverted V-shape. It may be also possible to locate the shooters 181 and 182 for forming the ribbons 19 such that they form the inverted V-shape crossing above the open top of the bag 12. In the ribbon feeding means 20 shown in FIG. 7, the method for feeding two ribbons in parallel is adopted.

In FIG. 13(*b*), the ribbons affixed to the bag 12 are curled. To obtain the curled ribbons 12, a rod 192 need be installed between the feed roller 132 and the front shooter 181 as shown in FIG. 14 and the following steps are necessary; to wind the ribbon 19 on the rod 192, to make the ribbons 19 curled by heating the rod 192, to remove the ribbons from the rod 192, to cool them, to send them to the front shooter 181, and then in the same way as mentioned above, to sever the ribbons, and finally to firmly tie up the gathered neck 12*a* of the bag 12 together with the ribbons 19 by the tie piece 15*a*.

As seen from FIGS. 15(*a*) to 15(*f*), various shapes of severed ribons, such as in V-, toothed, circular arc, inverted V-, inclined and straight shapes, can be obtained. these shapes of the ribbons can be easily obtained by suitably changing the blades 187 of the cutter 186. For example, by using the cutter 186 in FIG. 9, the ribbon in inverted V-shape as shown in FIG. 15(*d*) can be obtained. Other shapes of the ribbons not shown here can be also obtained.

The ribbon 19 may be twisted from its leading tip to its center part when it is gathered together with the open top of the bag 12. When the twisted part affects an undesirable decorative impression of the ribbon, it is preferable to make notches 194 at proper positions of the ribbon 19 by the cutter 186. The notches 194 can be in straight, V-, rectangular circular arc shapes and the like. The notches 194 also prevent the ribbon 19 from slipping off the bag 12.

Although the plastic strip with the wire is used to securely tie up the open top of the bag 12 together with the ribbon, other materials can be used as the tie material. For example, when an adhesive tape is disposed on the bottom 75 of the elongated recess 74 such that the adhesive face of the tape is faced up, the rising movement of the forming plate 62 enables the adhesive tape securely tie up the open top of the bag 12 together with the ribbon 19. By using the adhesive tape, the twisting mechanism can be omitted.

Instead of the tie material 15, an adhesive means such as an adhesive label 196 can be used to affix the ribbon 19 to the bag as shown in FIGS. 17(*a*) and (*b*).

Also, a wide ribbon can be divided by means of the cutter 186 into two pieces and the two ribbons may be affixed to the bag. Besides, a printing mechanism for printing a date, quantity etc. can be housed in the ribbon cutter 22.

What is claimed is:

1. A method for affixing a ribbon to a bag comprising the steps of:

placing an open end of a bag between a pair of spaced apart pleating plates;

placing a tie piece to lie lengthwise in a given direction at a portion of the open end to be gathered so as to form a neck;

feeding a ribbon for a predetermined length from a continuous ribbon supply and placing an end of said ribbon at the open end of said bag;

cutting the ribbon to a predetermined length so as to form a decorative ribbon tip and forming a pair of notches on the periphery of the ribbon to accommodate therein the tie piece;

operating the pleating plates so as to pleat the open end of the bag along with said ribbon end;

gathering the pleated open end of the bag along with said ribbon to form a neck, said neck and said ribbon lying lengthwise in another direction which is substantially perpendicular to said given direction; and wrapping the tie piece around the neck of the bag such that the tie piece engages said notches in said ribbon and then twisting the ends of the tie piece to tie up the open end of the bag and retaining the ribbon so that the bag is closed and the ribbon is affixed to the bag.

2. A method for affixing a ribbon to a bag according to claim 1, wherein two ribbons are fed to be affixed in an inverted V-shape.

3. The method for affixing a ribbon to a bag according to claim 2, wherein the step of placing a tie piece at the open end of said bag comprises feeding a tie material from a continuous supply and cutting the tie piece therefrom to a selected length.

4. A method according to claim 1, wherein the step of cutting the ribbon tip and the step of forming said pair of notches are performed simultaneously.

5. An apparatus for affixing a ribbon to a bag comprising:

a pair of spaced apart pleating plates vertically separated from each other;

means for placing a bag at a predetermined position so as to position a portion of the bag near an open end thereof between said pleating plates;

means for feeding and locating a ribbon at the open end of the bag from a continuous supply including a feed roller and a pinch roller engaging said ribbon therebetween to feed said ribbon for a predetermined length when the feed roller is driven, a rockable tension arm at one end of which is mounted a tension roller pressed on the ribbon to cause a back tension in an initial position of the tension arm, a tension spring means for biasing the tension roller toward the initial position of the tension arm, and means for rocking the tension arm to pull out the ribbon for said predetermined length from the ribbon supply;

means for cutting the ribbon to said predetermined length to form a decorative tip and to form a pair of notches on the periphery of the ribbon to accommodate the tie piece therein;

means for actuating said pleating means to pleat and gather said portion of said bag along with said ribbon to form a neck;

means for placing a tie piece at said neck and lengthwise substantially perpendicular to said neck; and means for wrapping the tie piece around said neck of the bag such that the tie piece engages said notches in said ribbon and means for twisting the two ends of the tie piece so as to close the open end of the bag and affix the ribbon to the bag.

6. The apparatus according to claim 5, wherein said cutting means cuts the ribbon and forms said notches substantially simultaneously.

7. The apparatus according to claim 5, wherein said means for placing a tie piece at said neck comprises means for feeding tie material from a continuous supply and means for cutting the tie piece therefrom to a selected length.

8. The apparatus according to claim 5, wherein mesh-like slip-preventing means is formed on the surface of the feed roller, and the ribbon feeding means further includes a support plate on one end of which the pinch roller is supported and means for uniformly biasing the pinch roller on the surface of the feed roller.

9. The apparatus according to claim 8, wherein the biasing means of the ribbon feeding means is a tension spring disposed so as to provide uniform lateral friction of the ribbon between the feed roller and the pinch roller.

10. The apparatus according to claim 5, wherein the ribbon feeding means further includes a guide roller disposed between the feed roller and the tension arm, and a pressure plate on the lower surface of which a felt is attached to engage the ribbon between the guide roller and the felt.

* * * * *